US005354037A

United States Patent [19]

Venegas, Jr.

[11] Patent Number: 5,354,037

[45] Date of Patent: Oct. 11, 1994

[54] MULTIPLE DESIGN GUARDRAIL SYSTEM

[75] Inventor: Frank Venegas, Jr., 4165 Homestead, Howell, Mich. 48843

[73] Assignee: Frank Venegas, Jr., Hamburg, Mich.

[21] Appl. No.: 936,793

[22] Filed: Aug. 28, 1992

[51] Int. Cl.[5] ..... E04H 17/00

[52] U.S. Cl. ..... 256/59; 256/69; 256/65; 256/19

[58] Field of Search ..... 256/69, 65, 55, 59, 256/19; 403/237, 234, 191, 3, 4, 347; 446/120, 121, 122, 123, 124, 125, 127, 128

[56] References Cited

U.S. PATENT DOCUMENTS

| | | | |
|---|---|---|---|
| 1,452,875 | 4/1923 | Healy . | |
| 2,242,427 | 5/1941 | Heanue | 256/65 |
| 2,603,455 | 7/1952 | Welch . | |
| 2,625,769 | 1/1953 | Hubbard | 446/122 |
| 2,780,440 | 2/1957 | Krieger . | |
| 2,815,972 | 12/1957 | Lagervall | 256/65 |
| 2,915,831 | 12/1959 | Parker | 446/124 |
| 2,927,513 | 3/1960 | Dove . | |
| 2,946,568 | 7/1960 | Ogden . | |
| 3,385,617 | 5/1968 | Gehring . | |
| 3,471,182 | 10/1969 | Schroer | 256/65 |
| 3,519,292 | 7/1970 | Krikorian . | |
| 3,776,520 | 12/1973 | Charles et al. . | |
| 3,963,218 | 6/1976 | Glaesener . | |
| 4,007,919 | 2/1977 | Totten | 256/59 |
| 4,060,222 | 11/1977 | Pitkin et al. | 403/4 |
| 4,461,461 | 7/1984 | Caron . | |
| 4,508,321 | 4/1985 | Morimoto | 256/65 |
| 4,516,756 | 5/1985 | Beatty . | |
| 4,540,160 | 9/1985 | Zanavich et al. . | |
| 4,702,459 | 10/1987 | Moschner . | |
| 4,750,713 | 6/1988 | Hirose . | |
| 4,776,719 | 10/1988 | Kreider | 446/122 |
| 4,892,292 | 1/1990 | Russell . | |
| 4,895,544 | 1/1990 | Fischer | 446/124 |
| 4,930,754 | 6/1990 | Caron et al. . | |
| 4,952,092 | 8/1990 | Ballerstein | 256/69 |
| 4,953,830 | 9/1990 | Weaver, III . | |
| 5,170,996 | 12/1992 | Venegas | 256/69 |
| 5,180,323 | 1/1993 | Justice | 446/125 |
| 5,193,786 | 3/1993 | Guenther | 256/59 |
| 5,255,897 | 10/1993 | Pepper | 256/59 |

FOREIGN PATENT DOCUMENTS 2011007 7/1979 United Kingdom .

OTHER PUBLICATIONS

Drawing specification for a modular rail system by the Spiratex Company, Feb. 11, 1991.

*Primary Examiner*—Randolph A. Reese
*Assistant Examiner*—Anthony Knight
*Attorney, Agent, or Firm*—Gifford, Groh, Sprinkle, Patmore and Anderson

[57] ABSTRACT

The guardrail assembly includes at least two tubular metal stanchion posts having a base, at least one aperture through one side of each stanchion post and at least one horizontal rail having a fastener at each end for extending into the respective stanchion post apertures. The horizontal rail has an inner metal pipe, an outer plastic pipe, and an end plate for supporting the fastener. Following insertion of the fastener of the horizontal rail into the stanchion post aperture, a threaded nut positioned in each stanchion post engages the threaded fastener at each end of the horizontal tubular rail to retain the fastener within the stanchion posts. In one embodiment, a tubular plastic sheath having at least one aperture is slipped onto the tubular metal stanchion post having at least one aperture and the apertures are aligned to form a stanchion having an aperture prior to insertion of the fasteners into the stanchion apertures. In an alternative embodiment, the stanchion has a plurality of apertures for receiving the fasteners of a plurality of horizontal rails. In a preferred embodiment, the stanchion has an upper set of horizontally aligned apertures and a lower set of horizontally aligned apertures where, most preferably, the upper apertures are also aligned vertically with the lower apertures.

3 Claims, 2 Drawing Sheets

MULTIPLE DESIGN GUARDRAIL SYSTEM

BACKGROUND OF THE INVENTION

This invention generally relates to a guardrail and, more particularly, to a unique rigid guardrail assembly which can be quickly installed, dismantled, moved and reassembled, in factories, parking lots, stadiums, stairways, porches, balconies and the like.

Guardrails are commonly used in factories and warehouses to direct vehicle traffic and to prevent the vehicles from running into other objects causing severe damage either to the object, the vehicle, or both. Generally, these guardrails are made from steel. While steel guardrails are quite strong, they also generally are quite rigid and, therefore, do not possess high energy absorbing capabilities. Another disadvantage of steel guardrails is that they require maintenance because they rust. An alternative to steel guardrails are plastic guardrails which, as compared with steel guardrails, can be energy absorbing, are low maintenance, and also have the advantage of being easily color-coded. Unfortunately, plastic guardrails do not provide the same strength that is a desirable characteristic of steel guardrails. Therefore, it would be highly desirable to have available guardrails which combine the respective desirable characteristics of plastic and steel guardrails.

A common drawback to many currently available steel, plastic or steel/plastic guardrail assemblies is that once they are assembled in one place, they essentially become fixtures in that location. Hence, although such guardrail assemblies are common, they are not easily removed from one location and reassembled in another location. As a result, there exists a need for an improved guardrail assembly which combines the desirable characteristics of plastic and steel guardrail assemblies, yet allows the ready assemblage and disassemblage of such a guardrail assembly.

SUMMARY OF THE INVENTION

The present invention provides a knock down rail assembly which is readily and easily assembled and disassembled. The rail assembly includes at least two vertical tubular stanchions having at least one aperture through one side of each stanchion defined therein and at least one horizontal tubular rail having a first end and a second end and including a threaded fastener at each end for extending into the respective stanchion apertures. A threaded nut positioned in each stanchion engages the threaded fastener at each end of the horizontal tubular rail to retain the fastener within the stanchions.

In a preferred embodiment, the present invention is a guardrail assembly which includes at least two vertically oriented support stanchions, the stanchions having an outer plastic sheath and a tubular metal post, at least one aperture through one side of each stanchion, and a base where a lower end of the post is anchored to the base, and at least one horizontal rail having an outer plastic pipe and an inner metal pipe, the inner metal pipe having a fastener attached to each end. Following the slipping of the plastic sheath over the tubular metal post and the outer plastic pipe over the inner metal pipe, each fastener of the horizontal rail is fitted into a stanchion aperture where a receiving means positioned in the stanchions reversibly receives the fasteners. In one embodiment, the fasteners are a threaded fastener. In another embodiment, the fasteners are supported, respectively, by an end plate attached to the interior of the horizontal metal pipe at both the first and second ends, the fastener preferably being centrally attached to the plates. In a further embodiment, the receiving means is a threaded nut positioned in the interior of the tubular metal stanchion posts, the nut having an aperture for reversibly receiving said threaded fastener.

In an alternative embodiment, the guardrail assembly includes at least two vertically oriented support stanchions, the stanchions having an outer plastic sheath and a tubular metal post, at least two aligned apertures through one side of each stanchion, and a base where a lower end of the post is anchored to the base, a first horizontal rail having an outer plastic pipe and an inner metal pipe, and a second horizontal rail having an outer plastic pipe and an inner metal pipe, the inner metal pipes of each rail having a fastener attached to each end. Following the slipping of the plastic sheaths over the tubular metal posts and the outer plastic pipes over the inner metal pipes, the fasteners of the first and second horizontal rails are fitted into the aligned stanchion apertures where a receiving means positioned in the stanchions reversibly receives the fasteners. In one embodiment, the fasteners are a threaded fastener. In another embodiment, the fasteners are supported by an end plate attached to the interior of the horizontal metal pipes at both the first and second ends, the fasteners preferably being centrally attached to the plates. In a further embodiment, the receiving means is a threaded nut positioned in the interior of the tubular metal stanchion posts, the nut having an aperture for reversibly receiving said threaded fastener.

In a further alternative embodiment, the guardrail assembly includes at least one center vertically oriented support stanchion, the center stanchion having an outer plastic sheath and a tubular metal post, at least two apertures through one side of each stanchion, and a base where a lower end of the post is anchored to the base, at least two outer vertically oriented support stanchions, the outer stanchions having an outer plastic sheath and a tubular metal post, at least one aperture through one side of each stanchion, and a base where a lower end of the post is anchored to the base, and at least two horizontal rails having an outer plastic pipe and an inner metal pipe, the inner metal pipes having a fastener attached to each end. Following the slipping of the plastic sheaths over the tubular metal posts and the outer plastic pipes over the inner metal pipes, the fasteners of the horizontal rails are fitted into the center stanchion apertures and the outer stanchion apertures where receiving means positioned in the stanchions reversibly receive the fasteners. In one embodiment, the fastener is a threaded fastener. In another embodiment, the fastener is supported by an end plate attached to the interior of the horizontal metal pipe at both the first and second ends, the fastener preferably being centrally attached to the plates. In a further embodiment, the receiving means is a threaded nut positioned in the interior of the tubular metal stanchion posts, the nut having an aperture for reversibly receiving said threaded fastener.

In yet a further alternative embodiment, the guardrail assembly includes at least one center vertically oriented support stanchion, the center stanchion having an outer plastic sheath and a tubular metal post, at least two aligned apertures through one side of the center stanchion, and a base where a lower end of the post is anchored to the base, at least two outer vertically oriented support stanchions, the outer stanchions having an outer plastic sheath and a tubular metal post, at least one aperture through one side of each stanchion, and a base where a lower end of the post is anchored to the base, and at least two horizontal rails having an outer plastic pipe and an inner metal pipe, the inner metal pipes having a fastener attached to each end. Following the slipping of the plastic sheaths over the tubular metal posts and the outer plastic pipes over the inner metal pipes, the fasteners of the horizontal rails are fitted into the center stanchion aligned apertures and the outer stanchion apertures where receiving means positioned in the stanchions reversibly receive the fasteners. In one embodiment, the fastener is a threaded fastener. In another embodiment, the fastener is supported by an end plate attached to the interior of the horizontal metal pipe at both the first and second ends, the fastener preferably being centrally attached to the plates. In a further embodiment, the receiving means is a threaded nut positioned in the interior of the tubular metal stanchion posts, the nut having an aperture for reversibly receiving said threaded fastener.

In other embodiments, a plurality of stanchions, sheaths and horizontal rails can be used. These and other objects, advantages and features of this invention will become apparent upon review of the following specification in conjunction with the drawings.

DETAILED DESCRIPTION OF THE PREFERRED EMBODIMENT

Figure 1:
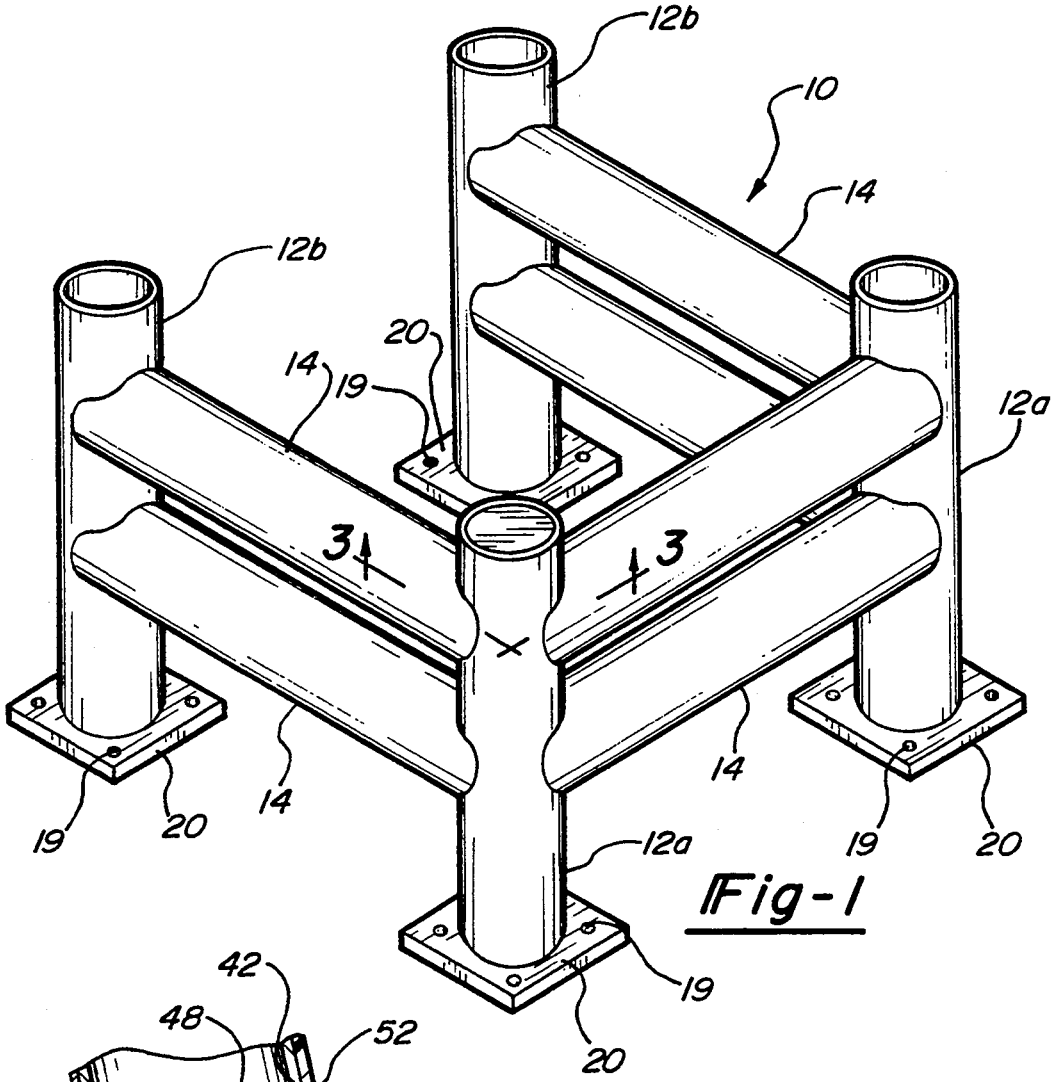
FIG. 1 is a perspective view of the guardrail assembly of the present invention.
Figure 3:
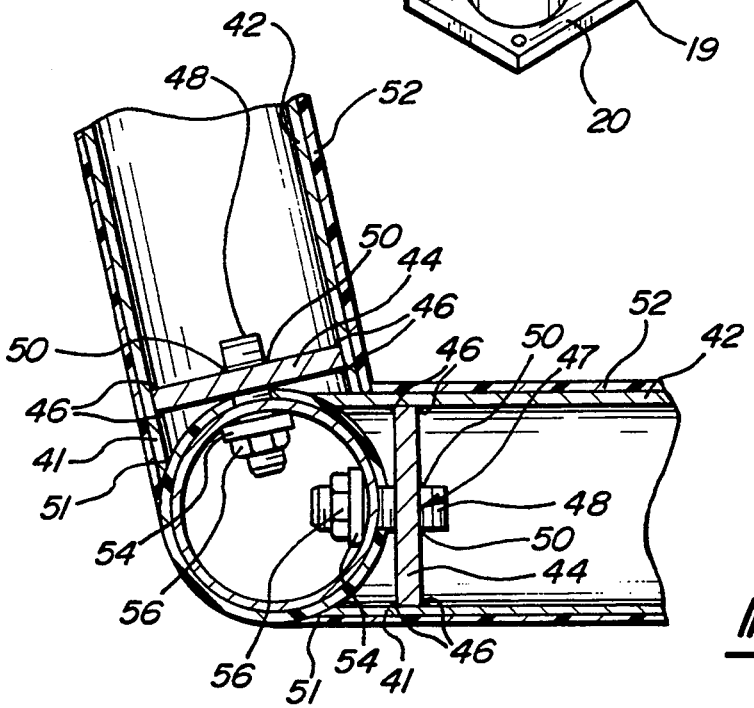
FIG. 3 is a fragmentary cross-sectional view of the locking mechanism of the present invention taken along the lines III—III in FIG. 1.
Figure 2:
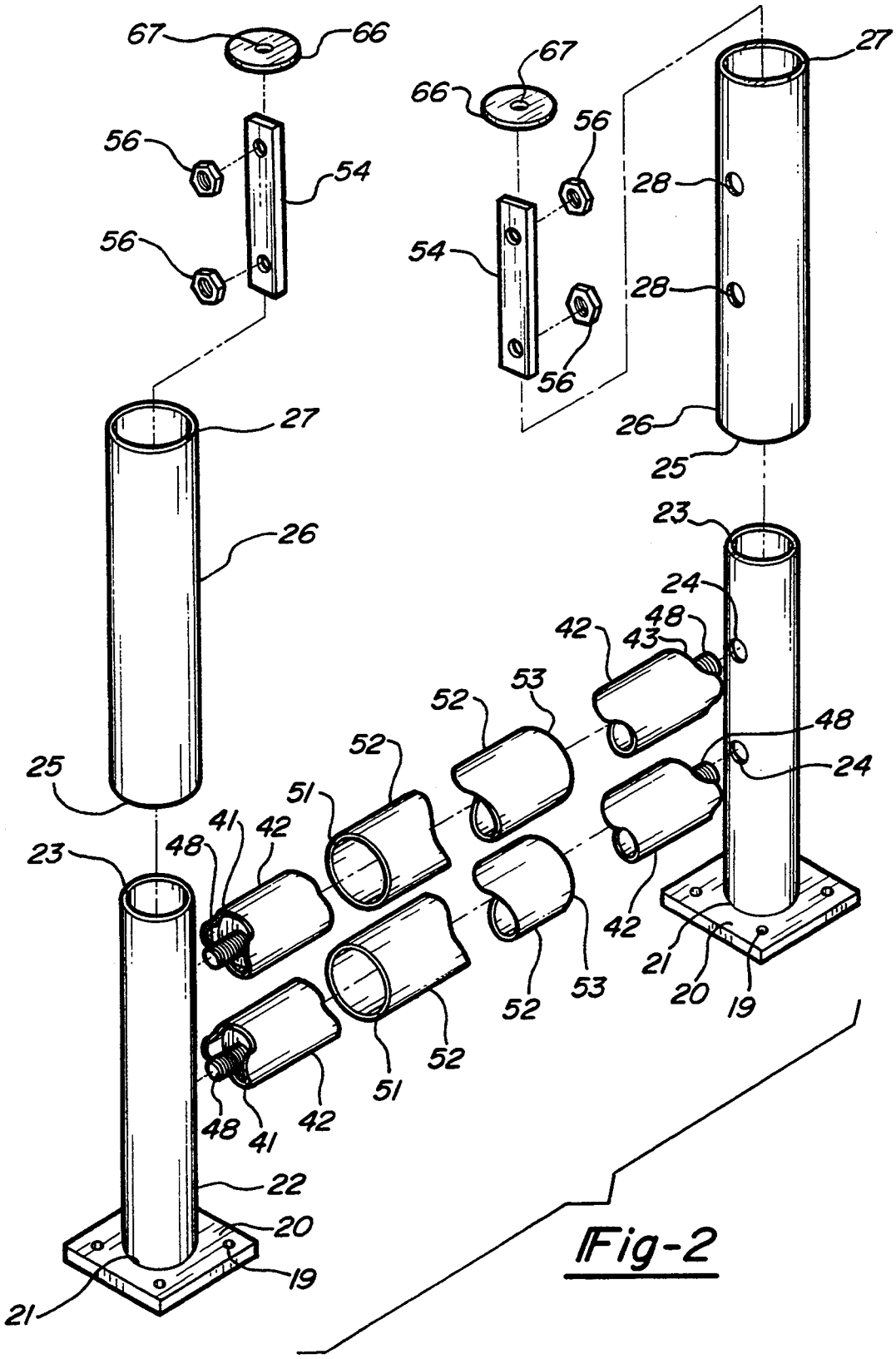
FIG. 2 is an exploded view of the guardrail assembly of the present invention.

Referring now to the drawings and the embodiments illustrated therein, in which like numerals indicate like parts throughout the several views, FIG. 1 shows a guardrail assembly 10 including a plurality of upright stanchions 12 (12*a* and 12*b*) and a plurality of horizontal rails 14. As shown in FIG. 2, the plurality of upright stanchions 12 each include a tubular metal post 22 having a base 20, a lower end 21, an upper end 23 and a plurality of apertures 24, and a tubular sheath 26 having a plurality of apertures 28. As shown in FIGS. 2 and 3, the plurality of horizontal rails 14 each include a metal pipe 42, having a first end 41 and a second end 43, and a plastic pipe 52, having a first end 51 and a second end 53, where metal pipe 42 has a pair of end plates 44 and a pair of threaded fasteners 48. As also shown in FIGS. 2 and 3, a washer 54 is fitted around fasteners 48 prior to the placement of a threaded nut 56 onto fasteners 48.

With reference to FIGS. 2 and 3, the guardrail assembly 10 is assembled by assembling a plurality of stanchions and horizontal rails. Specifically, guardrail assembly 10 is assembled by sliding tubular sheath 26 onto post 22 and aligning the plurality of apertures 24 of post 22 with the plurality of apertures 28 of sheath 26 to form stanchion 12. Sheath 26 has a first end 25 conforming with base 20, a flat second end 27 and has interior dimensions which are greater than or equal to the exterior dimensions of post 22. Horizontal rail 14 is formed by locating metal pipe 42 in plastic pipe 52, plastic pipe 52 having interior dimensions which are greater than or equal to the exterior dimensions of metal pipe 42.

After sheath 26 is slid onto post 22 and metal pipe 42 is located within plastic pipe 52, post apertures 24 are aligned with sheath apertures 28 to allow fitting of threaded fasteners 48 of horizontal rail 14 into the stanchion apertures to allow the attachment of horizontal rail 14 to stanchion 12. First end 41 and second end 43 of metal pipe 42 and first end 51 and second end 53 of plastic pipe 52 preferably conform with stanchion 12. Washers 54 are then fitted around fasteners 48 followed by the placement of threaded nut 56 onto fasteners 48. Threaded nut 56 is accessible from the top of stanchion 12 to allow the insertion of a wrench to tighten nut 56.

Prior to the assembly of guardrail assembly 10, end plates 44 are attached by plate welds 46 to the interior of metal pipe 42 at first end 41 and second end 43 of metal pipe 42 (FIG. 3). Threaded fastener 48 is then inserted into a plate aperture 47 and held in place there by fastener welds 50.

Following the placement of threaded fastener 48 into the stanchion apertures, a plurality of endcaps 66 may then be used to cover the open ends of stanchion 12. In a preferred embodiment, sheath 26 is slightly longer than post 22. The resulting overlap of sheath 26 over post 22 creates a space at the end of stanchion 12 to receive endcaps 66. Because endcaps 66 are sized essentially to equal the interior dimensions of sheath 26, endcaps 66 can be fitted to that space. Endcaps 66 contain an endcap aperture 67 to facilitate their removal.

Following the assemblage of guardrail assembly 10, base 20 of stanchion 12 is bolted into the ground, i.e., concrete with a plurality of bolts 19. The preferred expandable bolt for the installation is the RAWL-BOLT TM available from The Rawl Plug Company, Inc., Two F.B. Powers Square, New Rochelle, New York. Installation involves the use of a hammer drill to drill holes in the concrete. Base 20 is then positioned over the holes and expandable bolts 19 are then driven into the holes by the hammer drill. A crescent or socket wrench is then used to tighten bolts 19. Following the proper positioning of tubular metal post 22, the guardrail assembly can be assembled.

A wide variety of designs can be formed with guardrail assembly 10. The simplest design is where there are only two stanchions supporting a single horizontal rail. This design can be supplemented by placing a second horizontal rail parallel to the first horizontal rail. In this case, the stanchion apertures for receiving the fasteners of the horizontal rails are aligned vertically.

In a preferred embodiment, stanchion 12 has an upper set of horizontally aligned apertures and a lower set of horizontally aligned apertures. Most preferably, the upper apertures will also be aligned vertically with the lower apertures. Having a plurality of apertures in stanchion 12 allows for the assembly of a wide variety of guardrail designs. For example, as shown in FIG. 1, guardrail assembly 10 can have center stanchions 12*a* and outer stanchions 12*b*. As shown in FIG. 1, center stanchions 12*a* will have two pairs of horizontally aligned apertures and two pairs of vertically aligned apertures for receiving fasteners 48. Because the apertures are positioned on stanchions 12*a* less than 180° apart, a guardrail assembly can be formed to cordon off an area without having to use additional stanchions. As shown in FIG. 1, outer stanchions 12*b* have a pair of vertically aligned apertures for receiving fasteners 48. Of course, these outer stanchions could also have additional apertures produced therein so that guardrail assembly 10 could be extended to any desired design.

Guardrail assembly 10 is strong enough to become a permanent fixture where it is erected. There are instances, however, when it would be beneficial to be able to move or remove all or part of the guardrail. Removal of the present guardrail assembly 10 simply involves the reversal of the above-listed assemblage steps. Specifically, stanchion base 20 is removed by untightening bolts 19 which are holding base 20 in the ground. End-caps 66, if present, are pried loose and threaded nuts 56 are untightened and removed. Horizontal rail 14 and stanchion 12 can then be quickly and easily removed. All the parts can then be moved to another location where guardrail assembly 10 can be reassembled quickly and easily. The only new parts required are the expandable bolts 19. Where repair of a portion of guardrail assembly 10 is required, its knockdown characteristics facilitate the quick and easy maintenance of the damaged portion.

With respect to the preferred materials for use in the present invention, it is preferred that the plastic pipe and the plastic sheath be formed from high density polyethylene although other plastic materials may be used. Regarding the metal pipe, the end plate and the stanchion posts and bases, it is preferred that they be formed from a metal selected from the group including steel, aluminum and iron.

The above description is considered that of the preferred embodiment only. Modifications of the invention may occur to those of ordinary skill in the art. Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows.

1. A knockdown guardrail assembly comprising:

at least one center vertically oriented support stanchion, said center stanchion including a tubular plastic sheath and a tubular metal post said tubular metal post having an outside dimension less than or equal to the inside dimension of said tubular plastic sheath, said tubular metal post further having at least two pairs of apertures, one pair of apertures being in a horizontally aligned relationship and the other pair of apertures being in a vertically aligned relationship, said tubular plastic sheath having at least two apertures through said tubular plastic sheath, said tubular post being located in said tubular plastic sheath such that said apertures in said tubular plastic sheath and at least one pair of apertures in said tubular metal post align with each other;

receiving means in said center stanchion for receiving a fastener;

at least two outer vertically oriented support stanchions, said outer stanchions including a tubular plastic sheath and a tubular metal post, said tubular metal post having an outside dimension less than or equal to the inside dimension of said tubular plastic sheath said tubular plastic sheath having at least on aperture through one side of said tubular plastic sheath, said tubular metal post having at least one aperture through one side of said tubular metal post, said tubular metal post being located in said tubular plastic sheath such that said apertures in said tubular plastic sheath and said tubular metal post align with each other;

additional receiving means within said outer stanchion for receiving a fastener;

at least two horizontal rails, said horizontal rails including a plastic pipe and a metal pipe, said metal pipe having an outside dimension less than or equal to the inside dimension of said plastic pipe said metal pipe being located in said plastic pipe said metal pipe having a first end and a second end; and a fastener fixed at each of said first and second metal pipe ends of said horizontal rails for fitting into one of said pairs of apertures of said center stanchion and said apertures of said outer stanchions whereby said receiving means positioned in said center and outer stanchions removably receive said fasteners and said assembly may be arranged in different angular configurations;

wherein said fastener is a threaded fastener;

wherein each of said receiving means is a threaded nut positioned in the interior of said tubular metal stanchion posts said nut having an aperture for removably receiving said threaded fastener.

2. A knockdown guardrail assembly comprising:

at least one center vertically oriented support stanchion, said center stanchion including a tubular plastic sheath and a tubular metal post, said tubular metal post having an outside dimension less than or equal to the inside dimension of said tubular plastic sheath, said tubular metal post further having at least two pairs of apertures, one pair of apertures being in a horizontally aligned relationship and the other pair of apertures being in a vertically aligned relationship, said tubular plastic sheath having at least two apertures through said tubular plastic sheath, said tubular post being located in said tubular plastic sheath such that said apertures in said tubular plastic sheath and at least one pair of apertures in said tubular metal post align with each other;

receiving means in said center stanchion for receiving a fastener;

at least two outer vertically oriented support stanchions, said outer stanchions including a tubular plastic sheath and a tubular metal post, said tubular metal post having an outside dimension less than or equal to the inside dimension of said tubular plastic sheath, said tubular plastic sheath having at least on aperture through one side of said tubular plastic sheath, said tubular metal post having at least one aperture through one side of said tubular metal post, said tubular metal post being located in said tubular plastic sheath such that said apertures in said tubular plastic sheath and said tubular metal post align with each other;

additional receiving means within said outer stanchion for receiving a fastener;

at least two horizontal rails, said horizontal rails including a plastic pipe and a metal pipe said metal pipe having an outside dimension less than or equal to the inside dimension of said plastic pipe, said metal pipe being located in said plastic pipe, said metal pipe having a first end and a second end; and a fastener fixed at each of said first and second metal pipe ends of said horizontal rails for fitting into one of said pairs of apertures of said center stanchion and said apertures of said outer stanchions whereby said receiving means positioned in said center and outer stanchions removably receive said fasteners and said assembly may be arranged in different angular configurations; wherein said fastener is a threaded fastener; said threaded fastener being supported by an end plate attached to the interior at each end of said horizontal metal pipes;

wherein each of said receiving means is a threaded nut positioned in the interior of said tubular metal stanchion posts, said nut having an aperture for removably receiving said threaded fastener.

3. A knockdown guardrail assembly comprising:

at least one center vertically oriented support stanchion, said center stanchion including a tubular plastic sheath and a tubular metal post, said tubular metal post having an outside dimension less than or equal to the inside dimension of said tubular plastic sheath, said tubular metal post further having at least two pairs of apertures, one pair of apertures being in a horizontally aligned relationship and the other pair of apertures being in a vertically aligned relationship, said tubular plastic sheath having at least two apertures through said tubular plastic sheath said tubular post being located in said tubular plastic sheath such that said apertures in said tubular plastic sheath and at least one pair of apertures in said tubular metal post align with each other;

receiving means in said center stanchion for receiving a fastener;

at least two outer vertically oriented support stanchions, said outer stanchions including a tubular plastic sheath and a tubular metal post, said tubular metal post having an outside dimension less than or equal to the inside dimension of said tubular plastic sheath, said tubular plastic sheath having at least on aperture through one side of said tubular plastic sheath said tubular metal post having at least one aperture through one side of said tubular metal post, said tubular metal post being located in said tubular plastic sheath such that said apertures in said tubular plastic sheath and said tubular metal post align with each other;

additional receiving means within said outer stanchion for receiving a fastener;

at least two horizontal rails said horizontal rails including a plastic pipe and a metal pipe, said metal pipe having an outside dimension less than or equal to the inside dimension of said plastic pipe, said metal pipe being located in said plastic pipe said metal pipe having a first end and a second end; and a fastener fixed at each of said first and second metal pipe ends of said horizontal rails for fitting into one of said pairs of apertures of said center stanchion and said apertures of said outer stanchions whereby said receiving means positioned in said center and outer stanchions removably receive said fasteners and said assembly may be arranged in different angular configurations;

wherein said fastener is a threaded fastener;

said threaded fastener being supported by an end plate attached to the interior at each end of said horizontal metal pipe;

wherein said threaded fastener is centrally attached to said end plate;

wherein each of said receiving means is a threaded nut positioned in the interior of said tubular metal stanchion posts, said nut having an aperture for removably receiving said threaded fastener.

* * * * *